US006953256B2

(12) United States Patent
Turner

(10) Patent No.: US 6,953,256 B2
(45) Date of Patent: Oct. 11, 2005

(54) ILLUMINATED TAP HANDLE

(76) Inventor: Brent Turner, 2018 C St., San Diego, CA (US) 92103

( * ) Notice: Subject to any disclaimer, the term of this patent is extended or adjusted under 35 U.S.C. 154(b) by 31 days.

(21) Appl. No.: 10/632,020

(22) Filed: Jul. 31, 2003

(65) Prior Publication Data

US 2005/0024850 A1 Feb. 3, 2005

(51) Int. Cl.[7] ..... F21V 33/00; F21L 4/00

(52) U.S. Cl. ..... 362/96; 362/101; 362/186; 40/332

(58) Field of Search ..... 362/96, 101, 194, 362/195, 157, 186, 203, 208, 253, 399; 40/332

(56) References Cited

U.S. PATENT DOCUMENTS 1,225,865 A * 5/1917 Schneible ..... 40/332
2,414,446 A * 1/1947 Carbone ..... 40/332
2,631,393 A * 3/1953 Hetherington ..... 40/332
3,286,385 A * 11/1966 Tate, Jr. ..... 40/332
5,412,547 A * 5/1995 Hornblad et al. ..... 40/332
5,504,663 A * 4/1996 Tucker ..... 362/101
6,021,960 A * 2/2000 Kehat ..... 362/96

* cited by examiner

*Primary Examiner*—Alan Cariaso
(74) *Attorney, Agent, or Firm*—Jeffrey A. Travis, Esq.

(57) ABSTRACT

One object of the invention is to provide an illuminated tap handle including a handle with one end capable of being secured to a tap and a threadable and detachable end allowing the placement of a removable energy source into the handle completing a circuit and illuminating a light source connected to a conducting strip inside the handle when the threadable end is substantially threaded onto the handle and a conducting portion on the threadable end touches the conducting strip and energy source. Another object is where the conducting strip is situated within the tap handle such that when the threadable end is partially or completely unthreaded the tension of the conduction strip is released and situated just above and not touching the energy source, but when the threadable end is substantially threaded onto the tap handle, the conducting strip is again pressed onto the energy source completing the circuit.

12 Claims, 2 Drawing Sheets

ILLUMINATED TAP HANDLE

BACKGROUND OF THE INVENTION

1. Field of the Invention

The present invention relates to the field of bar advertisement, supplies, and related collectibles. More specifically, the invention relates to a bar tap handle that is illuminated so as to market a particular brand of beverage.

2. Description of the Related Art

Due to the increasing number of bars, pubs, and micro-breweries marketing more and more beers to patrons, there has been a growing need for each beer brand's distributors to distinguish their product from all others. The number of beers now being offered at each location is not inconsequential and is often in the number of 100 or more at a single location. Obviously, even the beer products of the largest beer manufacturers can be lost amidst the myriad of small and large brews despite having spent hundreds of millions of dollars in advertisement costs.

Historically, beer distributors and manufacturers have relied on such things as branded neon signs, coasters, tap handles and other marketing techniques to highlight their product in a last ditch attempt to gain notice and ultimately—a sale. These are typically low-cost marketing items either sold at cost by the manufacturers or distributors or even given away as "freebies" so as to increase brand name recognition. These are also items that over time have become valuable to those who have an interest in bar-related collectibles.

One way in which manufacturers and distributors have marketed their products is through the use of tap handles. These are handles that usually have a male end that is placed onto a female portion of a tap spigot. Most all of the tap spigots are of the same size and shape so that any conforming tap handle is simply inserted into the tap so long as the tap end of the handle conforms to a standard tap mount. When the tap handle is pulled, a bar beverage is dispensed from the spigot portion of the tap. Each tap handle has some form of brand recognizing color, trademark, decoration, or shape so as to identify that particular brand of beverage. In this way, undecided patrons at the selling establishment are lured by the brand names on the tap handles to purchase the tap that is most pleasing to their eye.

There have been attempts to illuminate tap handles although they have been unsuccessful largely due to their cost of manufacture, the lack of mechanical simplicity, and lack of a portable power supply. (See, for example, U.S. Pat. Nos. 2,414,446; 3,286,385; and 3,326,385)

The present invention better meets the marketing needs of the manufacturers, distributors, and establishment owners by providing a portable, inexpensive, and illuminated tap handle thereby making the illuminated brand more noticeable to the patron. This is an item that may be placed on any generic tap in any establishment, and manufactured at a very low cost using an inexpensive and readily available power source.

SUMMARY OF THE INVENTION

The object of the invention is to provide an illuminated tap handle, which includes a handle having a threadable end into which an energy source, such as a disposable battery, is placed into the body of the tap handle at which time one end of the energy source connects to the light source either directly or through the use of a conductor. Molded into the tap handle is a light source connected to a conducting strip. A circuit is completed after an energy source is inserted into the tap handle and a threadable detachable end is completely threaded onto the handle, a conducting portion on the threadable end touches the conducting strip and the energy source. In an alternative embodiment, the conducting strip is situated within the tap handle in such a way that when the threadable end is partially or completely unthreaded the tension of the conduction strip is released so that it is situated just above and not touching the energy source but when the threadable end is completely threaded onto the tap handle, the conducting strip is again pressed onto the energy source completing the circuit and illuminating the tap.

DETAILED DESCRIPTION OF THE DRAWINGS

Figure 1:
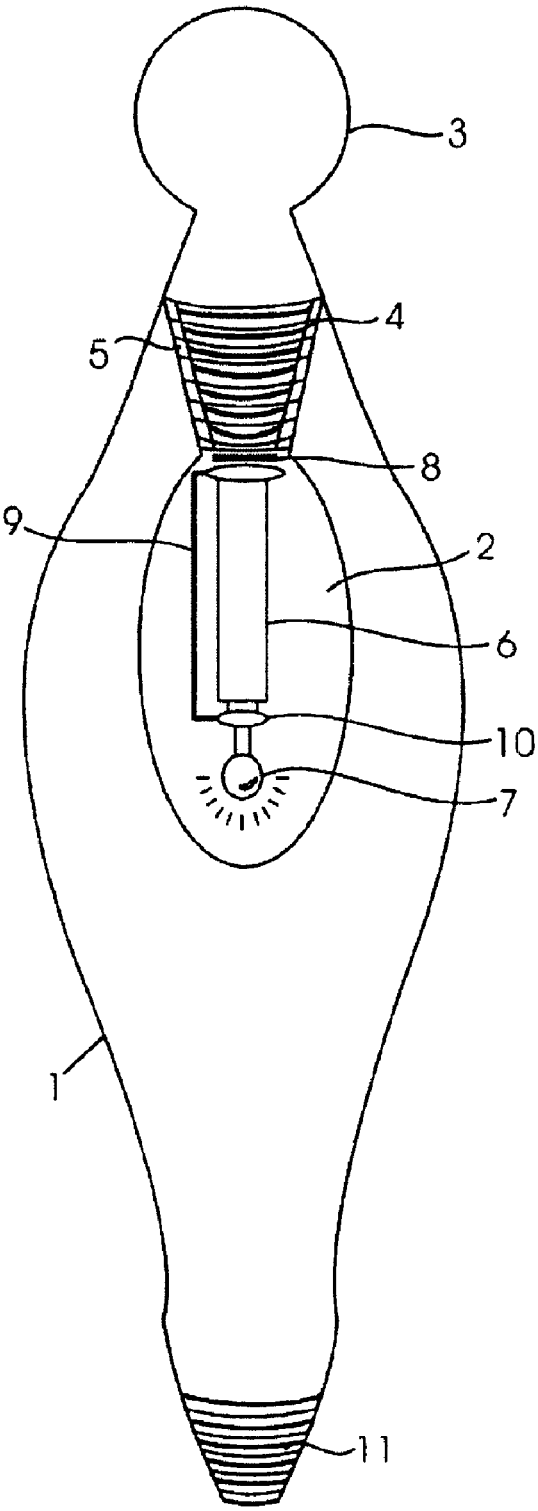
FIG. 1 shows a cross-sectional view of the illuminated tap handle where the circuit is completed by a conducting portion on the tip of the detachable top end and the bottom end is threaded and capable of being threaded onto a standard tap.
Figure 2:
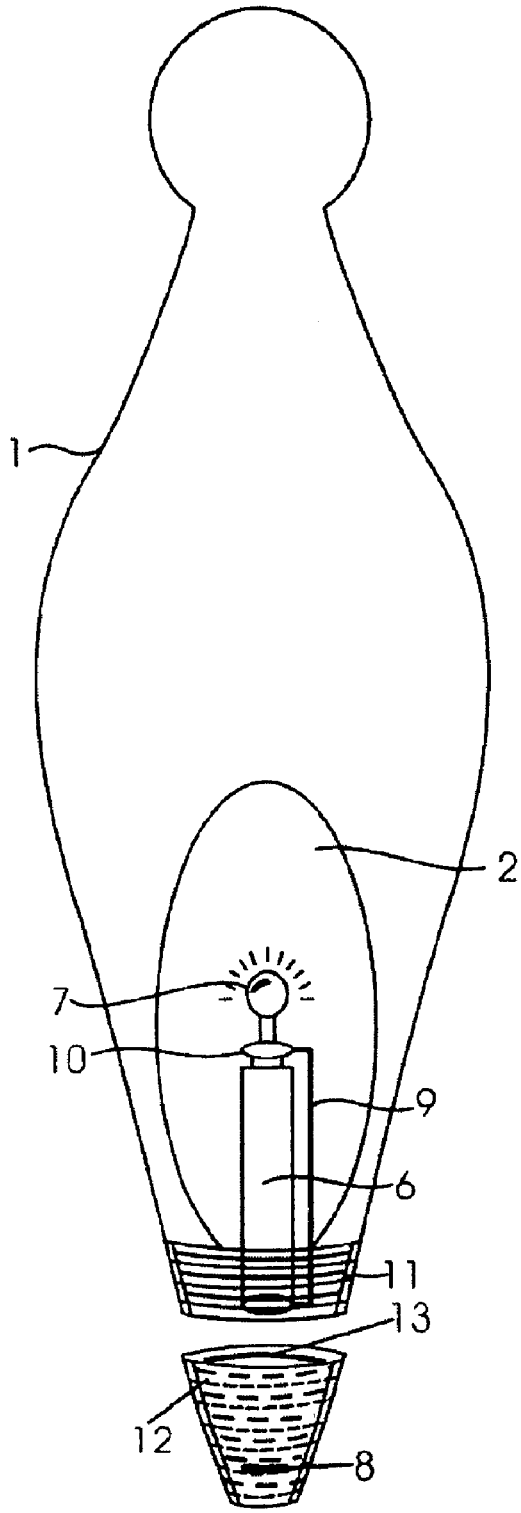
FIG. 2 shows a cross-sectional view of the illuminated tap handle where the circuit is completed when the detachable bottom end of the handle is threaded onto the bottom of the tap handle.

The claimed invention is illustrated in FIGS. 1 and 2. In FIG. 1, the invention comprises a tap handle portion (1) that has a hollow portion (2) inside to allow for the insertion of a portable energy source and circuitry elements. The handle portion can be of any size, color, decoration, shape, or brand logo or trademark so long as it is capable of connecting to a tap. For example a tap handle could be beveled, decorated with an appropriate trade name, formed to imitate a certain characteristic of the beverage manufacturer, or imbued with any kind of color. Additionally, the handle portion could be constructed from any kind of materials such as Lucite, plastic, glass or any other material preferably ones that allow for the transmission of light. Since this invention is intended primarily as a "freebie" marketing tool, a hard plastic or other inexpensive translucent material is preferred. On the top end of the tap handle is a detachable end (3) that can be removed to allow a portable power source, such as a disposable battery, to be inserted or removed into the handle portion. One means for making the end detachable is through the use of threading (4) on the detachable end enabling it to be threaded onto the handle portion. (1) In FIG. 1, the detachable end is threaded (4) and fits into a threadable end on the tap handle. (5) Contained within the handle portion is a circuit completed by a removable energy source, (6) a lighting element, (7) a conducting portion (8) on the detachable end, and a conducting strip (9). The energy source is capable of connecting either directly to the lighting element or indirectly through the use of an intermediate conductor (10) when it is placed into the handle portion. The lighting element is coupled to the conducting strip. The conducting strip (9) in FIG. 1 is a thin piece of metal capable of acting as a conductor and capable of touching the conducting portion when the conducting portion on the detachable end is threaded onto the handle. In this embodiment, the conducting strip is coupled to the lighting element near the base of the lighting element although it is not limited to the base.

In any embodiment, where the elements necessary for completing the circuit are situated within the tap handle is a matter of design since each element will need to b placed where they best meet the illuminating needs of the overall design of the handle. Since the handle is generally a solid piece of material, the energy source, intermediate conductor, lighting element, and conducting strip are normally placed inside a molded space inside the hollow portion of the handle in a form capable of containing the circuitry elements allowing the circuit to be completed when the detachable end is completely threaded onto the handle. The energy source (6) is preferably a low voltage battery such as an AAA or AA disposable or rechargeable battery. The lighting element (7) is preferably a low voltage incandescent bulb or light emitting diode although any form of illuminating element can be placed within the handle for illumination. The conducting portion (8) is best placed anywhere on the detachable end so that when the detachable end is either threaded onto the handle or otherwise attached to the handle portion it comes into contact with the conducting strip and the energy source thereby completing the circuit and illuminating the lighting element. Alternatively, a switch element could be placed anywhere on the outside of the handle that would allow for the illumination to be turned on and off by controlling the placement of the conducting strip inside the handle in relation to either the conducting portion or the energy source.

In FIG. 1, the conducting portion (6) is a thin slice of metal, placed on the very tip of the detachable end. The conducting strip (9) is situated such that it and the conducting portion will only come into contact with each other when the threaded portion is completely threaded onto the handle portion. In this way, there is no need for a separate switch element to illuminate the tap as in other related art since partially or completely unthreading the detachable end will complete or terminate the circuit and thereby turn on or off the illumination. This becomes an advantage over other illuminated tap handles that require much more elaborate, inconvenient, and costly mechanisms for switching on and off the lighting element. The conducting portion can also be a metal spring or other means for connecting to the energy source so long as it is capable of touching the conducting strip and the energy source. In its simplest form, the detachable end is made of a conducting material such as copper or other metal that can conduct an electric current and becomes the conducting portion.

On the opposite end of the handle portion—the bottom of the tap handle (11)—is capable of being inserted onto a standard tap mount or spigot. In FIG. 1, the bottom end of the tap handle, as is typical of most tap handles, is capable of being threaded onto a tap. However, the bottom end could be non-threadable and crafted in such a way so as to be simply inserted onto the tap with the weight of the tap handle and its close-fitting placement in the spigot acting as a means for securing it in place.

In another alternative embodiment, the conducting strip can be a flexible piece of conductive metal that is situated between the energy source and the detachable end such that when the detachable end is unthreaded the tension of the conducting strip pulls itself away from the energy source thereby terminating the circuit but, when the detachable end is threaded onto the handle it pushes the conducting strip onto the energy source completing the circuit and illuminating the lighting element. In this way, there need not be a conducting portion because the pressure of the threadable end will force the conducting strip onto the energy source completing the circuit without an conducting portion.

In a further modification to the invention as shown in FIG. 2, the bottom of the tap handle (11) is detachable and the conducting portion (6) is inside. The detachable bottom end is a hollow cone with threading on the outside (12) and on the inside. (13) The outside threading allows it to be threaded onto the tap spigot and the inside threading allows it to be threaded onto the bottom of the tap handle, which is also threaded. In this embodiment the conducting portion is placed inside the hollow of the detachable bottom so that once it is threaded onto the handle it is inserted up into the inside of the handle making it capable of touching both the conducting strip and the energy source and completing the circuit. All the other elements of the handle can remain similarly situated as in FIG. 2, albeit upside down in the handle. Once the detachable end is partially or completely unthreaded, the circuit is broken and illumination ceases. In any embodiment where the detachable end is on the bottom of the handle, the hollow of the handle that allows for the placement of the removable energy source must be narrow enough such that when the energy source is inserted it is held in place upside down by the close-fitting of the sides of the hollow portion surrounding the energy source. Or, a flexible material portion could be situated on the inside of the hollow of the handle that would press against the energy source and keep it from falling out of the handle when it is turned upside down.

I claim:

1. An illuminated tap handle comprising:

a handle portion with a detachable top end and a hollow portion inside the handle that opens up to the detachable top end;

a light source coupled to the handle portion;

a conducting portion coupled to the detachable end;

an energy source removeably connectable to the light source and removable from the handle portion;

a conducting strip with a first end and a second end;

the first end of the conducting strip coupled to the light source;

the conducting portion capable of touching the second end of the conducting strip and the energy source when the detachable top end is attached to the handle portion; and the handle portion is capable of being secured to a tap.

2. The illuminated tap handle of claim 1 further comprising:

the detachable top end threadably securable to the handle portion;

the handle portion threadably securable to a tap; and a conductor fixedly connected to the light source and removeably connectable to the energy source.

3. The illuminated tap handle of claim 1 wherein the light source is an incandescent light.

4. The illuminated dispensing handle of claim 1 wherein the light source is a light emitting diode.

5. An illuminated tap handle comprising:

a handle portion with a detachable bottom end and a hollow portion inside the handle that opens up to the detachable bottom end;

a light source coupled to the handle portion;

a conducting portion coupled to the detachable bottom end;

an energy source removeably connectable to the light source and removable from the handle portion;

a conducting strip with a first end and a second end;

the first end of the conducting strip coupled to the light source;

the conducting portion capable of touching the second end of the conducting strip and the energy source when the detachable bottom end is attached to the handle portion; and the detachable bottom end is capable of being secured to a tap.

6. The illuminated tap handle of claim 5 further comprising:

the detachable bottom end threadably securable to the handle portion;

the detachable bottom end threadably securable to a tap; and a conductor fixedly connected to the light source and removeably connectable to the energy source.

7. The illuminated tap handle of claim 6 wherein the light source is an incandescent light.

8. The illuminated tap handle of claim 6 wherein the light source is a light emitting diode.

9. An illuminated tap handle comprising:

a handle portion with a detachable top end and a hollow portion inside the handle that opens up to the detachable top end;

a light source coupled to the handle portion;

a conducting portion coupled to the detachable end;

an energy source removeably connectable to the light source and removable from the handle portion;

a flexible conducting strip with a first end and a second end;

the first end of the flexible conducting strip coupled to the light source;

the second end of the flexible conducting strip situated between the detachable end and the energy source;

the detachable top end capable of pressing the flexible conducting strip onto the energy source when it is attached to the handle; and the handle portion capable of being secured to a tap.

10. The illuminated tap handle of claim 9 further comprising:

the handle portion threadably securable to the handle portion;

the detachable top end threadably securable to the handle portion; and a conductor fixedly connected to the light source and removeably connectable to the energy source.

11. The illuminated tap handle of claim 9 wherein the light source is an incandescent light.

12. The illuminated tap handle of claim 9 wherein the light source is a light emitting diode.

* * * * *